United States Patent [19]

Shibata et al.

[11] Patent Number: 4,888,464

[45] Date of Patent: Dec. 19, 1989

[54] HEAT ROLL FOR ELECTROPHOTOGRAPHY

[75] Inventors: Ryoichi Shibata, Fukaya; Kiyoshi Kinugawa, Kumagaya; Tsutomu Iimura, Tachikawa; Yasuo Sawano, Saitama, all of Japan

[73] Assignee: Hitachi Metals, Ltd., Tokyo, Japan

[21] Appl. No.: 177,982

[22] Filed: Apr. 5, 1988

[51] Int. Cl.[4] ..... B21B 31/08; B21B 27/06; H05B 3/02; G03G 15/20

[52] U.S. Cl. ..... 219/216; 29/130; 29/132; 219/469; 355/285; 355/289

[58] Field of Search ..... 219/216, 469, 470, 471; 432/60, 228; 29/130, 132; 355/3 FU, 14 FU, 282, 285, 289, 290

[56] References Cited

U.S. PATENT DOCUMENTS

| | | | |
|---|---|---|---|
| 4,395,109 | 7/1983 | Nakajima et al. | 355/3 FU |
| 4,714,819 | 12/1987 | Yamashita . | |
| 4,724,305 | 2/1988 | Iimura et al. . | |
| 4,801,968 | 1/1989 | Kogure et al. | 355/3 FU |

FOREIGN PATENT DOCUMENTS

| | | | |
|---|---|---|---|
| EPA0240730 | 3/1987 | European Pat. Off. . | |
| EPA0261511 | 9/1987 | European Pat. Off. . | |
| 0158359 | 12/1981 | Japan | 355/3 FU |
| 0169168 | 10/1983 | Japan | 355/3 FU |
| 0198071 | 11/1983 | Japan | 355/3 FU |
| 0203471 | 11/1983 | Japan | 355/3 FU |
| 59-155873 | 5/1984 | Japan . | |
| 63-106682 | 9/1988 | Japan . | |

*Primary Examiner*—A. T. Grimley
*Assistant Examiner*—E. J. Pipala
*Attorney, Agent, or Firm*—Finnegan, Henderson, Farabow, Garrett & Dunner

[57] ABSTRACT

A heat roll for electrophotography of a surface heating type having a heating resistor is arranged such that a bonding layer, an insulating layer, a resistance layer, and a surface insulating layer are consecutively provided on an outer surface of a hollow cylindrical core, and a bearing member for fitting with a bearing is fitted at each opposite end of the heat roll. A pipe or a round bar formed of aluminum, an aluminum alloy, copper, a copper alloy, or the like which has a greater coefficient of thermal conductivity than that of mild steel is disposed inside the core to permit a uniform distribution of the temperature. In addition, a gap of 0.2 mm or more is provided between the inner surface of the core and an outer peripheral surface of the member formed of the high-temperature conductive material. As a result, effects that are attributable to a difference in the coefficients of thermal conductivity can be alleviated, and a temperature rise of the heat roll up to a predetermined temperature can be accelerated.

6 Claims, 5 Drawing Sheets

HEAT ROLL FOR ELECTROPHOTOGRAPHY

BACKGROUND OF THE INVENTION

1. Field of the Invention

The present invention relates to improvements in a heat roll for electrophotography in which a bonding layer, an insulating layer, a resistance layer, and a surface insulating layer are provided sequentially on the outer surface of a core formed into a hollow tubular shape, and heat is generated by energization of the resistance layer so as to fix a toner image on a recording medium.

2. Description of the Prior Art

A conventionally known heat roll used in an electrophotographic printing system for thermally fixing a toner image transferred onto a recording medium such as copying paper is arranged such that a halogen lamp is provided in a hollow tubular core as a heat source to effect heating. With a heat roll of this type, however, there are drawbacks in that the rate of power consumption is large, and that a long warming-up time required until the start of copying after energization. In addition, there is another drawback in that the heat roll outside diameter cannot be made sufficiently small since the lamp is provided inside it. As a means of overcoming this drawback, a direct-heating heat roll is known in which a heating resistor is arranged on the outer surface of the core. FIG. 5 is a partial cross-sectional view illustrating one example thereof, in which an insulating layer 4 and a resistance layer 5 are provided on the outer surface of a core 2 formed into a hollow tubular shape via a bonding layer 3. Electrode rings 6 are respectively fixed to opposite end portions of the resistance layer 5 and are electrically connected to the resistance layer 5. A feeder brush 7 is disposed such as to slidably abut against the outer periphery of each of the electrode rings 6. A surface insulating layer 8 is disposed on the outer periphery of the resistance layer 5 to electrically protect the insulating layer 5 and prevent the insulating layer 5 from becoming damaged by external force. Generally, a ceramic is used for the insulating layer 8 and the resistance layer 5. Incidentally, in cases where the core is formed of an insulating material, the bonding layer 3 and the insulating layer 4 may not be provided.

If a ceramic is used for the insulating layer or the resistance layer, the material of the core, should have a coefficient of thermal expansion which is close to that of the ceramic (generally, 5 to $10\times10^{-6}/°$ C). If an aluminum alloy which has a large coefficient of thermal expansion is used as the core, cracks occur in the ceramic owing to repetition of thermal loading during production or usage thereof, resulting in deterioration of its electrical properties and breakage of the resistor. In terms of economic efficiency, a ferrous alloy (e.g. mild steel, ferrite-based stainless steel, or martensite-based stainless steel) is most desirable. In addition, there are cases where an insulting ceramic formed of alumina or the like is used.

However, if a ferrous alloy, alumina or the like is used, since its coefficient of thermal conduction is smaller than those of aluminum, steel, and an alloy thereof, the temperature of each portion of the roll does not become uniform, so that there has been drawbacks in that faulty fixing occurs, and that the temperature of certain portions rises unacceptable.

SUMMARY OF THE INVENTION

Accordingly, an object of the present invention is to provide a heat roll for electrophotography which is capable of alleviating effects which are attributable to a difference in the coefficients of thermal expansion and of accelerating a rise in the temperature of the heat roll up to a predetermined temperature, thereby overcoming the above-described drawbacks of the prior art.

To this end, according to the present invention, there is provided a heat roll for electrophotography having a heating resistor, wherein a bonding layer, an insulating layer, a resistance layer, and a surface insulating layer are sequentially provided on the outer surface of a hollow cylindrical core, and a bearing member for fitting with a bearing is disposed at each opposite end of the heat roll. A pipe or a round bar formed of aluminum, and aluminum alloy, copper, a copper alloy, or the like which has a greater coefficient of thermal conductivity than that of mild steel is disposed inside the core.

In the present invention, a gap of 0.2 mm or more is preferably provided between the inner surface of the core and the outer surface of a member formed of a high-temperature conductive material so as to alleviate effects that are attributable to a difference in the coefficients of thermal expansion during a temperature rise. In addition, an arrangement is preferably provided in such a manner as to substantially prevent the axial movement of the pipe or the round bar. The above-described arrangements prevent the exfoliation of the insulating film, the resistance film, etc. In addition, in the present invention, since the high-temperature conductive material is provided inside the heat roll, there is the advantage of making the temperature uniform. Furthermore, if the gap of 0.2 mm or more is provided, the temperature rise up to a predetermined temperature of the heat roll is accelerated as compared with a case where a smaller gap is provided.

DETAILED DESCRIPTION OF THE PREFERRED EMBODIMENT

Figure 1:
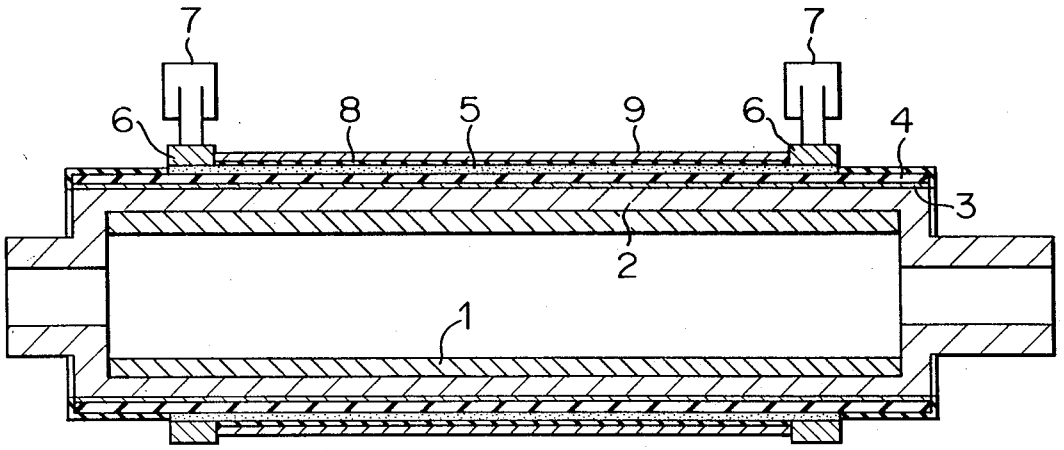
FIG. 1 is a cross-sectional view of a direct-heating-type heat roll in accordance with an embodiment of the present invention.

FIG. 1 is a cross-sectional view of a heat roll in accordance with the present invention. In the drawing, a pipe 1 is made of a high-temperature conductive material such as aluminum and has a thickness of, for instance, 2 to 3 mm. However, the material may be an aluminum alloy, copper, a copper alloy, or the like. If it is necessary, a solid bar may be used in place of the pipe 1. A core 2 made of mild steel is formed into a hollow tubular shape, and a gap of 0.2 mm or more in provided between the core 2 and the pipe 1. An outer surface of this core is sequentially coated with a bonding layer 3 made of Ni-Al-Mo with a thickness of 25 μm, an insulating layer 4 made of $Al_2O_3$ with a thickness of 300 μm or thereabout, a resistance layer 5, i.e., a heating resistor, made of $Al_2O_3$+NiCr with a thickness of 70 μm or thereabout, and a surface insulating layer 8, i.e., an insulating film, made of $Al_2O_3$ with a thickness of 100 μm or thereabout. An electrode ring 6 made of a conductive material such as aluminum bronze is provided at each opposite end of the resistance layer 5 such as to project therefrom, and a feeder brush 7 is provided thereon such as to be slidable. Incidentally, the outer peripheral surface of the surface insulating layer 8 is coated with Teflon with a thickness of approximately 30 μm, while the end surface portions of the insulating layer 4 that are outside the electrode rings 6 are provided with insulation by means of silicone resin.

By virtue of the above-described arrangement, if a current for heating is supplied from the feeder brushes 7 to the resistance layer 5 via the electrode rings 6, the heat roll is capable of achieving its objectives.

EXAMPLE 1

Figure 2:
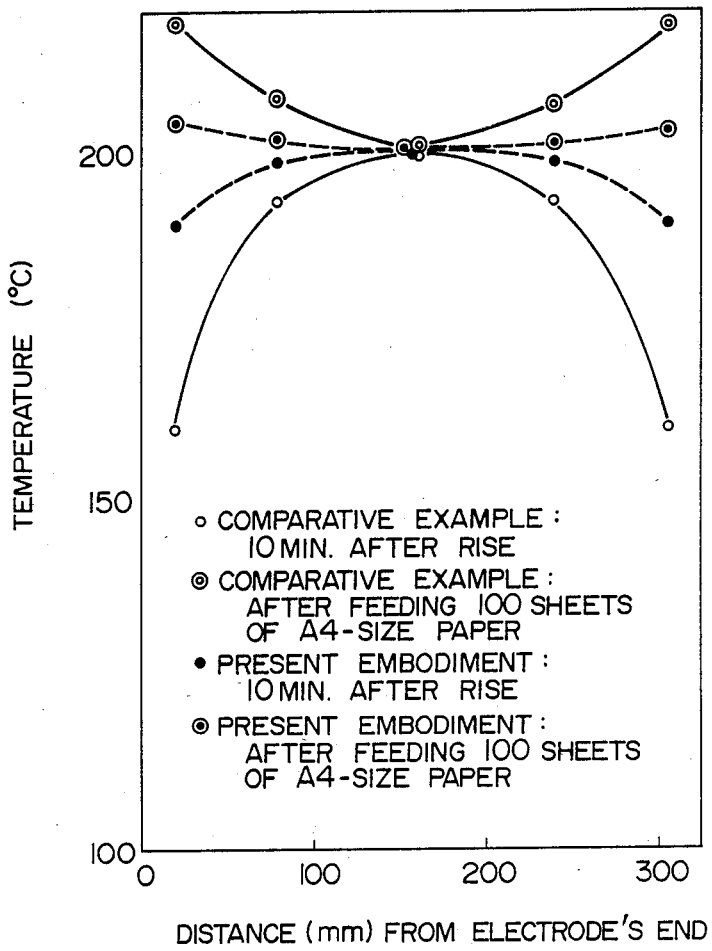
FIG. 2 is a graph illustrating the temperature distribution of a heat roll in accordance with Example 1 and a comparative example.

A pipe made of aluminum (A 5056) and having an outside diameter of 36.4 mm, an inside diameter of 33.8 mm, and a length of 350 mm was inserted into a conventional heat roll using a core made of mild steel and having an outside diameter of 40 mm, an inside diameter of 37.2 mm, and a length of 330 mm between electrodes in such a manner as to substantially correspond with the distance between the electrodes. A comparison was made between the temperature distribution in this case and that of a conventional structure in which the pipe was not provided. The results are shown in FIG. 2. In the graph, the dotted lines indicate temperature distributions obtained when the temperature of the heat roll in accordance with the invention became stable and immediately after 100 sheets of A-4 size paper were continuously fed. Meanwhile, solid lines indicate temperature distributions in the case of a conventional heat roll which was not provided with the high-temperature conductive material. As is apparent from the graph, the present invention displays a large significantly improves the temperature distribution, and contributes greatly to the improvement of the fixing performance.

EXAMPLE 2

Figure 3:
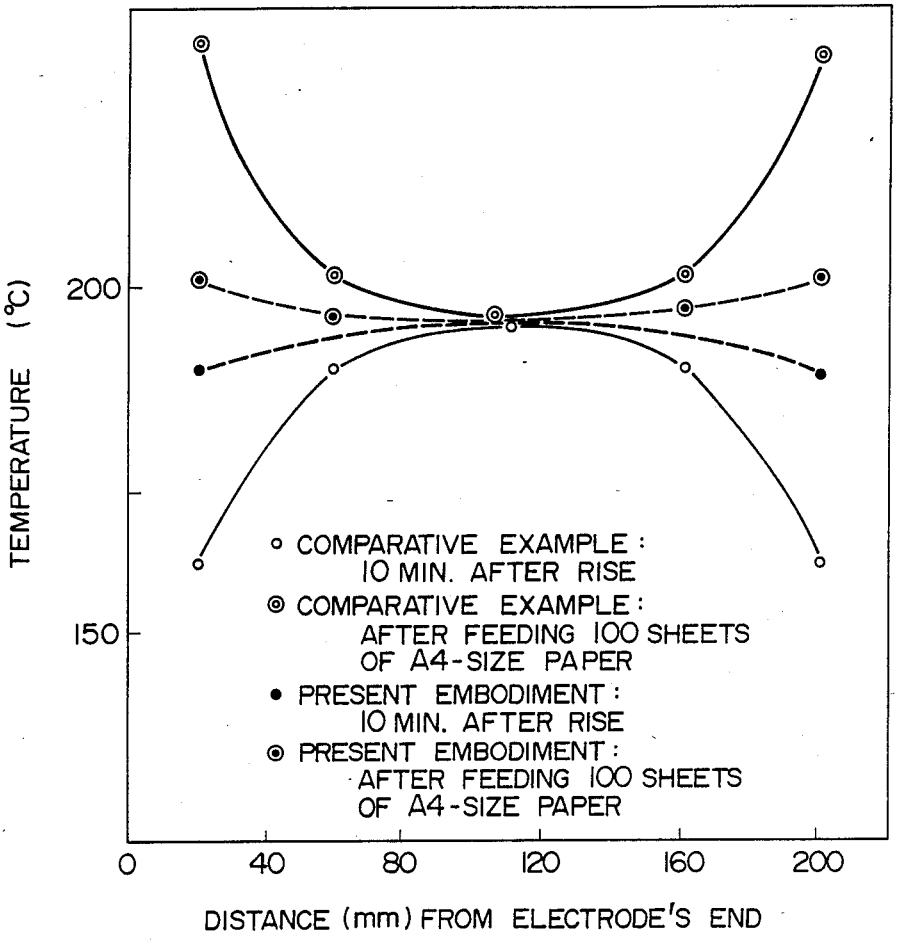
FIG. 3 is a diagram illustrating the temperature distribution of the heat roll in accordance with Example 2 of the present invention and a comparative example.

A round bar made of an aluminum alloy (A 5056) and having an outside diameter of 11.8 mm was inserted into a conventional heat roll using a core made of mild steel and having an outside diameter of 15 mm, an inside diameter of 12.6 mm, and a length of 220 mm between electrodes in such a manner as to substantially correspond with the distance between the electrodes. A comparison was made between the temperature distribution in this case and that of a conventional structure in which the round bar was not provided. The results are shown in FIG. 3. In the graph, the dotted lines indicate temperature distributions obtained when the temperature of the heat roll in accordance with the invention became stable and immediately after 100 sheets of A-4 size paper were continuously fed. Meanwhile, solid lines indicate temperature distributions in the case of a conventional heat roll which was not provided with the high-temperature conductive material. As is apparent from the graph, the present invention affords a substantial improvement in the temperature distribution.

EXAMPLE 3

A round bar made of an aluminum alloy (A 5056) and having a outside diameter of 16.8 mm was inserted into a conventional heat roll having an outside diameter of 20.0 mm, an inside diameter of 17.0 mm, and a length of 220 mm between electrodes in such a manner as to substantially correspond with the distance between the electrodes, and a test was conducted in the same way as Example 2. Consequently, results similar to those of Example 2 were obtained.

EXAMPLE 4

Figure 4:
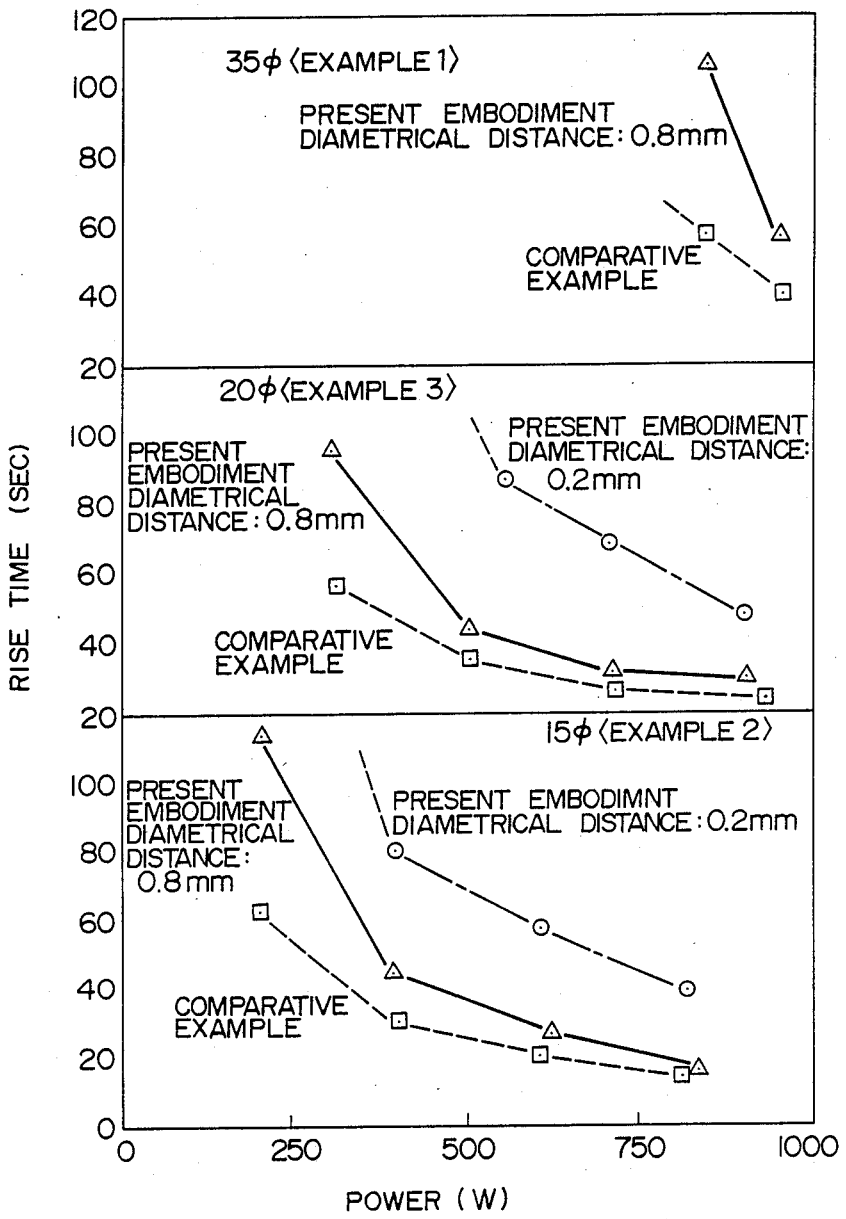
FIG. 4 is a diagram illustrating temperature rise characteristics based on diametrical differences between the inside diameter of the core and the outside diameter of the high-temperature conductive member in the present invention.
Figure 5:
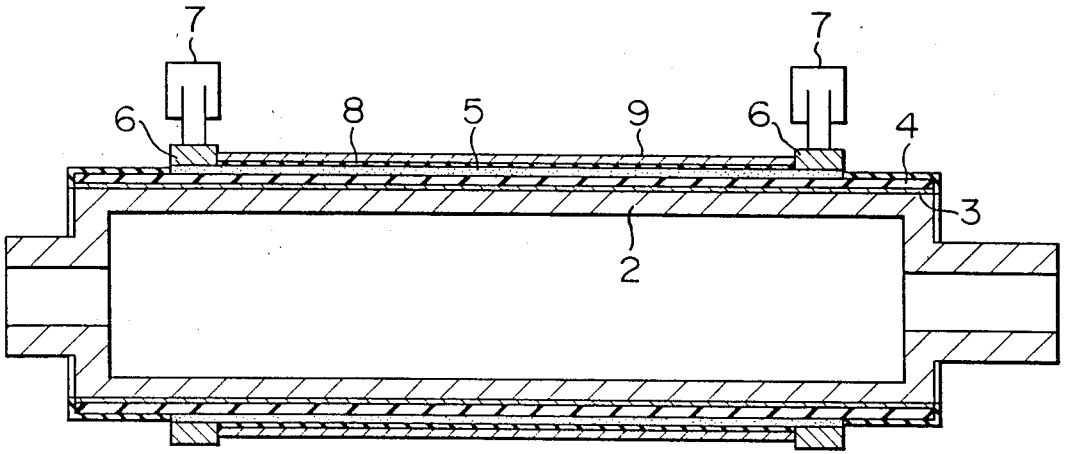
FIG. 5 PRIOR ART
FIG. 5 is a cross-sectional view illustrating a structure of a conventional heat roll.

Temperature rise characteristics up to 190° C. were examined by varying the diametrical difference between the inner surface of the roll and the outer surface of the high-temperature conductive material to 0.2 mm from 0.8 mm in the heat rolls of Examples 1, 2, and 3. The results are shown in FIG. 4.

As is apparent from this graph, a heat roll having a diametrical difference of 0.8 mm displayed a shorter rise time than the one having a diametrical difference of 0.2 mm. Particularly in cases where a roll diameter is 20 mm or less and the rise time is approximately 40 sec. or less, the temperature distribution was excellent, and the rise time was short, thus displaying good results.

Also, the diametrical clearance between the outer surface of the high-temperature conductive material and the inside surface of the core can be set such that the respective surfaces are brought into contact with each other when the heat roll temperature is raised to an elevated temperature, e.g. about 200° C.

As a means of providing the high-temperature conductive material on the inner surface of a conventional heat roll, in addition to a method of inserting the same by providing a gap, as described above, it is possible to adopt a method in which the high-temperature conductive material is adhered by the use of an inner-surface flame spray gun, a method in which large gaps are provided and solder, adhesive, or the like is used for the gaps, or a method in which shrinkage fit or expansion fit is carried out.

Among these methods, a method in which the high-temperature conductive material is inserted by providing gaps is most simple, and since the occurrence of stress in the outer cylinder during heating is small, this method is most desirable.

In addition, it goes without saying that the inner high-temperature conductive material may be extended to the end portions of the roll, or a composite pipe may be used.

What is claimed is:

1. A heat roll for electrophotography of a surface-heating type having a heating resistor on an outer surface of a hollow cylindrical core made of mild steel, said heat roll comprising a high-temperature conductive material which is formed into the shape of a pipe or a round bar and has a greater coefficient of thermal conductance than that of mild steel, said high-temperature conductive material being inserted in said core.

2. The heat roll for electrophotography according to claim 1, wherein said high-temperature conductive material is formed of aluminum of an aluminum alloy.

3. The heat roll for electrophotography according to claim 1, wherein the outside diameter of said pipe or said round bar formed of said high-temperature conductive material is smaller than the inside diameter of said core, and a diametrical difference is provided therebetween.

4. The heat roll for electrophotography according to claim 3, wherein said diametrical difference is 0.2 mm or more.

5. The heat roll for electrophotography according to claim 4, wherein the outside diameter of said heat roll is 20 mm or less.

6. The heat roll for electrophotography as in claim 3 wherein said diametrical difference is set in relation to the relative thermal conductivities of said core and said high-temperature conductive material such that the inner surface of said core and the outer surface of said high-temperature conductive material are brought into contact with each other when the heat roll is raised to an elevated temperature.

* * * * *